US008499690B2

(12) United States Patent
Schwitzky

(10) Patent No.: US 8,499,690 B2
(45) Date of Patent: Aug. 6, 2013

(54) METHOD AND APPARATUS FOR FORMING AN INK PATTERN EXHIBITING A TWO-DIMENSIONAL INK GRADIENT

(75) Inventor: Volkmar Rolf Schwitzky, Würzburg (DE)

(73) Assignee: KBA-Notasys SA, Lausanne (CH)

( * ) Notice: Subject to any disclaimer, the term of this patent is extended or adjusted under 35 U.S.C. 154(b) by 921 days.

(21) Appl. No.: 12/526,955

(22) PCT Filed: Feb. 11, 2008

(86) PCT No.: PCT/IB2008/050488

§ 371 (c)(1),
(2), (4) Date: Oct. 30, 2009

(87) PCT Pub. No.: WO2008/099330

PCT Pub. Date: Aug. 21, 2008

(65) Prior Publication Data

US 2010/0089261 A1 Apr. 15, 2010

(30) Foreign Application Priority Data

Feb. 15, 2007 (EP) ..... 07102465

(51) Int. Cl.
*B41F 9/02* (2006.01)
*B41M 1/10* (2006.01)

(52) U.S. Cl.
USPC ..... 101/152; 101/170

(58) Field of Classification Search
USPC ..... 101/152, 350.3, 352.13, 350.1, 349.1, 101/487, 389.1, 170
See application file for complete search history.

(56) References Cited

U.S. PATENT DOCUMENTS

| | | | | |
|---|---|---|---|---|
| 2,733,656 | A | 2/1956 | Gottsching | |
| 3,438,324 | A * | 4/1969 | Sanders et al. | 101/378 |
| 4,479,431 | A | 10/1984 | Germann | |
| 5,042,378 | A | 8/1991 | Germann | |
| 5,062,360 | A | 11/1991 | Germann et al. | |
| 6,101,939 | A | 8/2000 | Giori et al. | |
| 6,634,292 | B2 * | 10/2003 | Fujiwara et al. | 101/141 |
| 6,868,782 | B2 * | 3/2005 | Dauner | 101/217 |
| 6,886,461 | B2 * | 5/2005 | Bolza-Schunemann | 101/352.06 |
| 2008/0271620 | A1 * | 11/2008 | Hoier et al. | 101/216 |

FOREIGN PATENT DOCUMENTS

| | | | |
|---|---|---|---|
| CH | 655 054 | A5 | 3/1986 |
| DE | 877 000 | | 5/1953 |
| EP | 0 351 366 | A2 | 1/1990 |
| EP | 0 415 881 | A2 | 3/1991 |
| EP | 0 949 069 | A1 | 10/1999 |

(Continued)

*Primary Examiner* — Ren Yan
*Assistant Examiner* — Leo T Hinze
(74) *Attorney, Agent, or Firm* — Seager, Tufte & Wickhem LLC

(57) ABSTRACT

There is described a method and an inking apparatus (50) for forming an ink pattern (80) on the surface of a form cylinder (15*b*) of a printing press, which ink pattern (80) exhibits, at least in part, a two-dimensional ink gradient extending in an axial direction and a circumferential direction on the surface of the form cylinder (15*b*). At least first and second chablon cylinders (20, 25) are placed one after the other along an inking path of the ink train (20, 25, 30, 31, 32, 33, 34, 35*a*, 35*b*, 36, 37) inking the form cylinder (15*b*) for distributing ink in the axial and circumferential directions and means (200, 201, 210, 211, 212, 250, 251, 260, 261, 262) are provided for subjecting the first and second chablon cylinders (20, 25) to cyclical oscillation movements in the axial direction and the circumferential direction.

20 Claims, 13 Drawing Sheets

(56) References Cited

FOREIGN PATENT DOCUMENTS

| | | | |
|---|---|---|---|
| EP | 1 053 887 | A2 | 11/2000 |
| EP | 1 053 887 | B1 | 4/2004 |
| RU | 2 143 342 | C1 | 12/1999 |
| RU | 2 143 344 | C1 | 12/1999 |
| RU | 2 147 282 | C1 | 4/2000 |
| WO | 2005/077656 | A1 | 8/2005 |

* cited by examiner

METHOD AND APPARATUS FOR FORMING AN INK PATTERN EXHIBITING A TWO-DIMENSIONAL INK GRADIENT

TECHNICAL FIELD

The present invention generally relates to a method and an apparatus for forming an ink pattern on the surface of a form cylinder of a printing press, which ink pattern exhibits, at least in part, a two-dimensional ink gradient extending in an axial direction and a circumferential direction on the surface of the form cylinder. The present invention is in particular applicable in the context of the production of security documents, such as banknotes, passports, ID documents, checks or the like securities.

BACKGROUND OF THE INVENTION

Forming an ink pattern on the surface of a form cylinder of a printing press, which ink pattern exhibits, at least in part, a two-dimensional ink gradient extending in an axial direction and a circumferential direction on the surface of the form cylinder is known as such in the art. This principle was recently developed by Russian entity Goznak and is exploited in the context of so-called two-dimensional iris printing (hereinafter referred to as "2D-iris printing"). 2D-iris printing is in particular described in European patent application EP 1 053 887 and associated Russian patent RU 2 143 344 C1, as well as in Russian patent RU 2 143 342 C1.

An apparatus for carrying out 2D-iris printing is furthermore described in Russian patent RU 2 147 282 C1. FIG. 10 annexed hereto is an illustration of the apparatus disclosed in this document, which apparatus derives from the configuration of the multicolour offset printing press disclosed in Swiss patent CH 655 054 A5. Reference numeral 103 in FIG. 1 designates a plate cylinder carrying one offset printing plate, 102 designates a blanket cylinder carrying one blanket, 101 designates an impression cylinder, 104 designates an ink-collecting cylinder with two blankets, 105 designates four selective-inking cylinders (or chablon cylinders), and 106 designates four inking devices for inking the corresponding selective-inking cylinders 105 (which inking devices are only partially shown). In the configuration illustrated in FIG. 10, plate cylinder 103, blanket cylinder 102 and chablon cylinders 105 are each one segment cylinders, while impression cylinder 101 and ink-collecting cylinder 104 are two-segment cylinders (Swiss patent CH 655 054 A5 shows a similar machine configuration where the impression cylinder and the ink-collecting cylinder are three-segment cylinders). In other words, a ratio between the diameter of the chablon cylinders 105 and the diameter of the ink-collecting cylinder 104 is 1:2.

Each chablon cylinder 105 is inked by its associated inking device 106 and carries one chablon plate with raised portions corresponding to selected areas to be inked on the plate cylinder 103 in the desired colour. Each chablon cylinder 105 thus inks corresponding areas on each blanket of the ink-collecting cylinder 104 to form a multicolour ink pattern which is transferred onto the surface of the plate cylinder 103, thus inking the offset printing plate with a multicolour ink pattern. The resulting ink pattern corresponding to the printing form carried by the plate cylinder 103 is then transferred to the blanket cylinder 102, which in turn transfers the ink pattern onto the printed substrate which passes between the blanket cylinder 102 and the impression cylinder 101.

This inking principle whereby a same printing plate is inked with a multicolour ink pattern is also known under the designation of "Orlof" principle. It differs from the conventional multicolour inking principle used in conventional offset printing wherein a plurality of printing plates each corresponding to a desired colour to be printed are provided and wherein each printing plate is inked by only one associated inking device. With such conventional inking principle, and in contrast to the Orlof principle, the resulting ink patterns of the plurality of printing plates are collected or regrouped on a same blanket before being transferred onto the printed substrate. A major advantage of the Orlof principle resides in the fact that, as one plate is inked with a multicolour ink pattern, a perfect register between the different colours is guaranteed, which perfect register is more difficult to counterfeit, especially when the printed pattern is formed of fines lines, such as guilloche patterns. In contrast, according to the conventional inking principle, the register between the different colours will depend on the precision with which the various ink patterns of the printing plates are transferred and collected on the same blanket.

According to patent RU 2 147 282 C1, and as generally taught in European patent application EP 1 053 887, at least one of the chablon cylinders 105 is subjected to cyclic oscillation movements in both the axial direction and the circumferential direction. In other words, the chablon cylinder 105 oscillates both horizontally from left to right and vice versa, and is accelerated and decelerated with respect to a nominal rotational speed of the printing press. Accordingly, during each revolution of the oscillated chablon cylinder 105, a patch of ink is transferred onto the surface of the blanket cylinder 104 at a slightly offset position as compared to the patch of ink applied during the previous revolution. After a certain number of cylinder revolutions, there results an ink pattern on the surface of the blanket cylinder 104 and on the downstream-located plate cylinder 103 which exhibits at least in part an ink gradient extending in both the axial and circumferential directions.

According to patent RU 2 147 282 C1, the distribution of ink in the two-dimensions, i.e. along the axial direction and circumferential direction, is performed exclusively upon transfer of the ink from the oscillated chablon cylinder 105 to the ink-collecting cylinder 104. This implies that the distance over which the ink is distributed is determined exclusively by the oscillation amplitude of the chablon cylinder 105. Increasing the distance over which ink is distributed would therefore mean increasing the oscillation amplitude of the said cylinder, which is possible in practice only up to a certain extent. In the case of the solution described in the above-mentioned patent publications, the oscillation amplitude is for instance in the range of ±0.1 mm to ±2 mm (i.e. a total amplitude of between 0.2 to 4 mm).

Furthermore, according to RU 2 147 282 C1, the oscillated chablon cylinders 105 are one-segment cylinders having the same size as the plate cylinder 103, i.e. cylinders exhibiting a fixed diameter determined by the configuration of the machine and the printing length of the sheets to be printed. A typical diameter of the chablon cylinders 105 is for instance 280.20 mm (i.e. with a circumference of 880.274 mm), which diameter is adapted for the printing of sheets having a standard format of usually up to 700 mm×820 mm. According to the solution described in patent RU 2 147 282 C1, a two-segment ink collecting cylinder is further used, i.e. a cylinder having twice the size of the chablon cylinders 105. The solution of patent RU 2 147 282 C1 accordingly requires a substantial amount of space and is therefore difficult to install in a compact manner in the inking system of a printing press.

U.S. Pat. No. 2,733,656 discloses a multicolour printing press comprising a printing cylinder carrying a plurality of relief plates which are inked by a plurality of so-called preprinting rollers that are associated in pairs parallel to one another, each preprinting roller being thus brought into contact with the surface of the relief plates carried by the printing cylinder. This document is totally silent about the creation of any ink gradient, whether one-dimensional or two-dimensional, or any cylinder or roller arrangement for distributing the ink in an axial or circumferential direction and does not provide any means therefor.

SUMMARY OF THE INVENTION

An aim of the invention is to improve the known methods and devices.

In particular, an aim of the present invention is to provide a solution that enables an increase of the distance over which the ink can be distributed without this necessitating an increase of the oscillation amplitude of the chablon cylinder used to distribute the ink.

Still another aim of the present invention is to provide a solution that helps improving the uniformity of the distribution of ink in the axial and circumferential directions.

A further aim of the present invention is to provide a solution that enables the design of a compact inking apparatus.

These aims are achieved thanks to the inking apparatus and method defined in the claims.

According to the invention, at least first and second chablon cylinders are placed one after the other along an inking path of the ink train inking the form cylinder for distributing ink in the axial and circumferential directions, which first and second chablon cylinders are subjected to cyclical oscillation movements in the axial direction and the circumferential direction. Thanks to this solution, and as discussed hereinafter in greater detail, one can achieve a better and more uniform distribution of ink along the axial and circumferential directions. One can furthermore achieve distribution of ink over a distance that is comparatively greater than with the prior art solution.

Advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The invention will be described hereinafter in the context of a sheet-fed offset printing press for printing security papers, in particular banknotes. As this will be apparent from the following, the illustrated printing press comprises a printing group adapted for simultaneous recto-verso offset printing of the sheets. This printing group is as such similar to that described in European patent application EP 0 949 069 which is incorporated herein by reference. It shall however be appreciated that the present invention could be applied in any other type of printing press wherein a ink pattern is to be applied on the surface of a form cylinder. Furthermore, while the following discussion will focus on the printing of sheets, the invention is equally applicable to the printing on a continuous web of material.

Figure 1A:
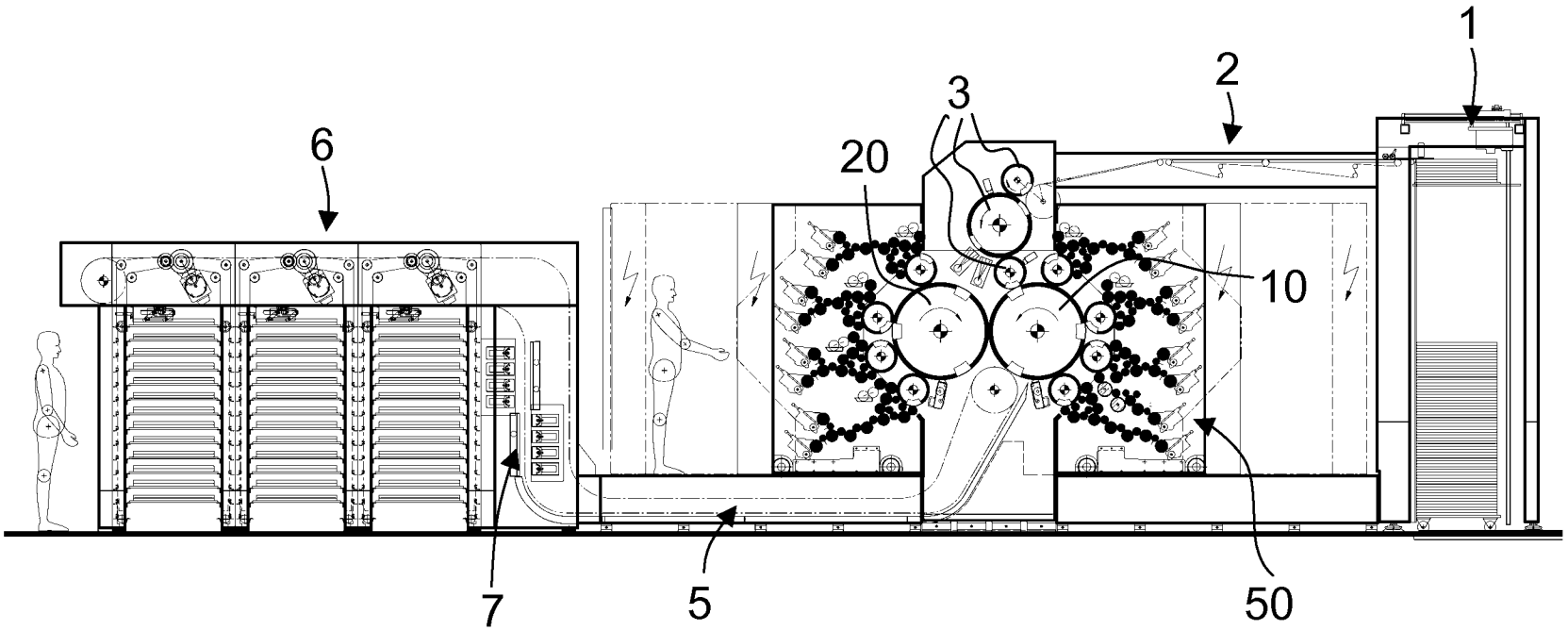
FIG. 1A is a side view of a sheet-fed offset print press of the type comprising a printing group for simultaneous recto-verso printing of the sheets, which printing press comprising an inking apparatus according to a first embodiment of the invention.
Figure 1B:
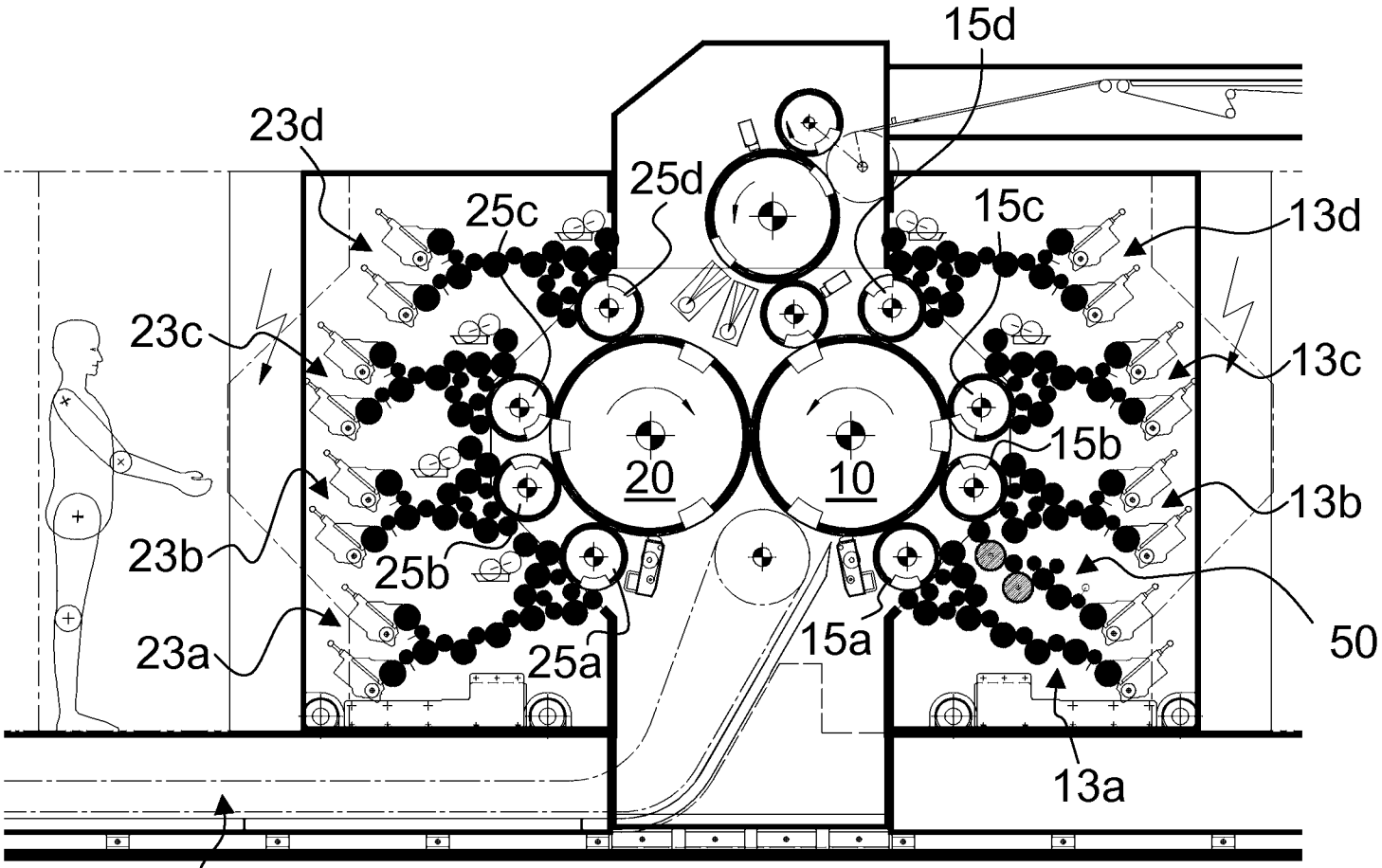
FIG. 1B is an enlarged side view of the printing group of the printing press of FIG. 1A.
Figure 1C:
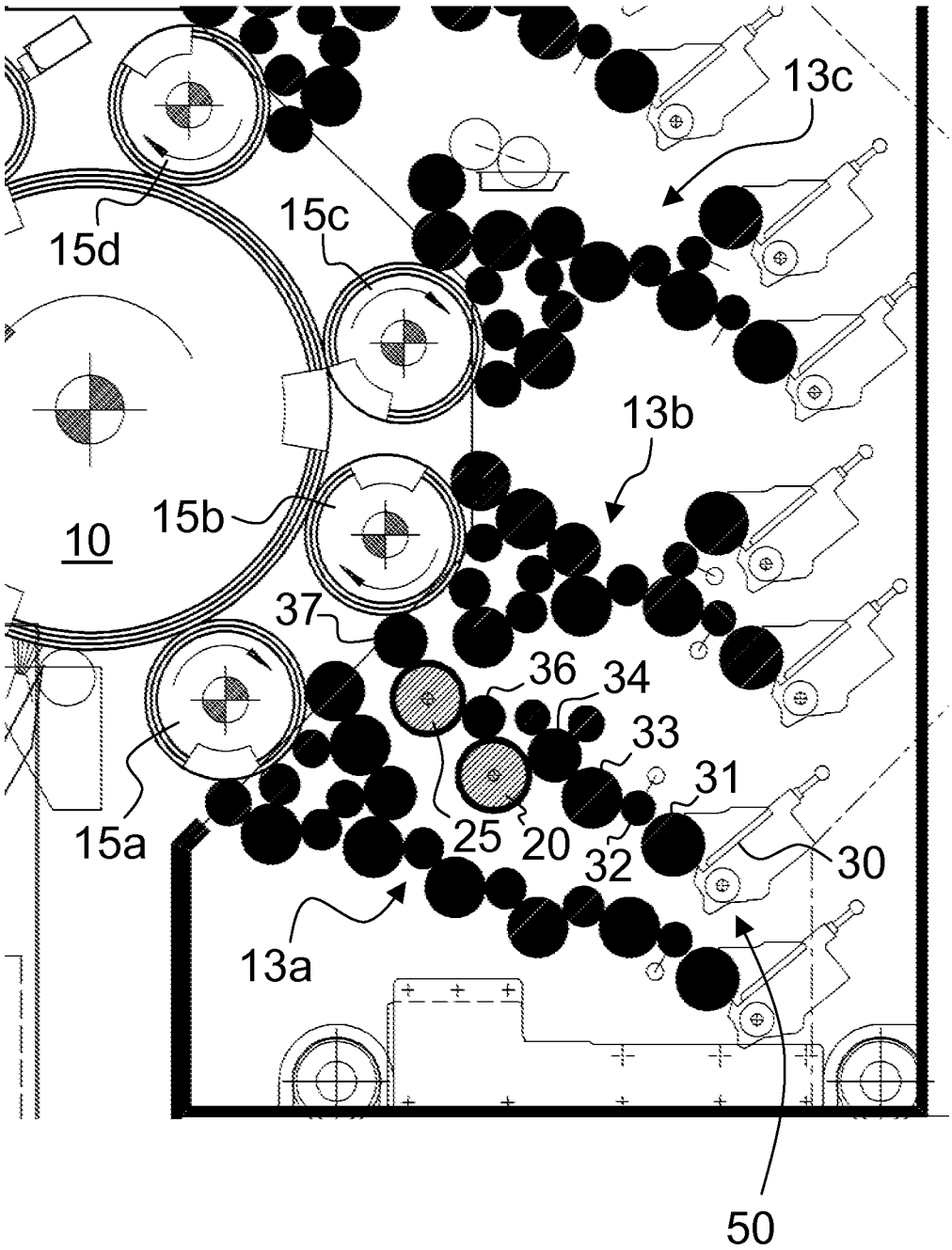
FIG. 1C is an enlarged side view of the right-hand side of the printing group of FIG. 1B.

FIGS. 1A, 1B and 1C are side views of a sheet-fed offset printing press equipped with an inking apparatus according to one embodiment of the invention. The printing group of this press, which is adapted in this case to perform simultaneous recto-verso offset printing of the sheets, comprises in a conventional manner two blanket cylinders (or printing cylinders) 10, 20 rotating in the direction indicated by the arrows and between which the sheets are fed to receive multicoloured impressions. In this example, blanket cylinders 10, 20 are three-segment cylinders, i.e. cylinder having a peripheral length approximately three times the length on the sheets. The blanket cylinders 10, 20 receive different inked patterns in their respective colours from plate cylinders, or form cylinders, 15*a* to 15*d* and 25*a* to 25*d* (four on each side—not referenced in FIG. 1A) which are distributed around the circumference of the blanket cylinders 10, 20. These plate cylinders 15*a*-15*d* and 25*a*-25*d*, which each carry a corresponding printing plate, are themselves inked by corresponding inking devices 13*a* to 13*b* and 23*a* to 23*d*, respectively. The two groups of inking devices 13*a*-13*d* and 23*a*-23*d* are advantageously placed in two inking carriages that can be moved toward or away from the centrally-located plate cylinders 15*a*-15*d*, 25*a*-25*d* and blanket cylinders 10, 20 (as schematically illustrated by the dashed lines in FIG. 1A).

Sheets are fed from a feeding station 1 located at the right-hand side of the printing group onto a feeding table 2 and then to a succession of transfer cylinders 3 (three cylinders in this example) placed upstream of the blanket cylinders 10, 20. While being transported by the transfer cylinders 3, the sheets may optionally receive a first impression on one side of the sheets using an additional printing group (not illustrated) as described in EP 0 949 069, one of the transfer cylinders 3 (namely the two-segment cylinder visible in FIGS. 1A and 1B) fulfilling the additional function of impression cylinder.

In case the sheets are printed by means of the optional additional printing group, these are first dried by appropriate means before being transferred to the blanket cylinders 10, 20 for simultaneous recto-verso printing as discussed in EP 0 949 069. In the illustrated example, the sheets are transferred onto the surface of the first blanket cylinder 10 where a leading edge of each sheet is held by appropriate gripper means disposed in cylinder pits between each segment of the blanket cylinder 10. Each sheet is thus transported by the first blanket cylinder 10 to the printing nip between the blanket cylinders 10 and 20 where simultaneous recto-verso printing occurs. Once printed on both sides, the printed sheets are then transferred as known in the art to a chain gripper system 5 for delivery in a sheet delivery station 6 comprising multiple delivery pile units (three in the example of FIG. 1A).

The chain gripper system 5 typically comprises a pair of chains holding a plurality of spaced-apart gripper bars (not shown) each provided with a series of grippers for holding a leading edge of the sheets. In the illustrated example, the chain gripper system extends from below the two blanket cylinders 10, 20, through a floor part of the printing press and on top of the three delivery pile units of the delivery station 6. The gripper bars are driven along this path in a clockwise direction, the path of the chain gripper system 5 going from the printing group to the sheet delivery station 6 running below the return path of the chain gripper system 5. Drying means 7 are disposed along the path of the chain gripper system in order to dry both sides of the sheets, drying being performed using infrared lamps and/or UV lamps depending on the type of inks used. In this example, the drying means 7 are located at a vertical portion of the chain gripper system 5 where the gripper bars are led from the floor part of the printing press to the top of the sheet delivery station 6. At the two extremities of the chain gripper system 5, namely below the blanket cylinders 10, 20 and at the outermost left-hand side part of the sheet delivery station 6, there are provided pairs of chain wheels for driving the chains of the chain gripper system 5. The printing press could additional comprise an inspection system for inspecting the quality of the printed sheets.

In the illustrated embodiment, the two lower inking devices 13*a* and 13*b* on the right-hand side of the printing group have been modified (as compared to the corresponding inking devices 23*a* and 23*b* on the left-hand side of the printing group) so as to provide space for a specifically-designed inking apparatus designated generally be reference numeral 50. As this will be explained hereinafter, this inking apparatus 50 is designed to form an ink pattern on the surface of the associated form cylinder, which ink pattern exhibits, at least in part, a two-dimensional ink gradient extending in an axial direction and a circumferential direction on the surface of the form cylinder. In this example, the inking apparatus 50 cooperates with plate cylinder 15*b*, which plate cylinder is also inked by the inking device 13*b*. In this context, it is preferable that the inking device 13*b* applies a light-coloured ink as a background (e.g. a yellow ink), while the inking apparatus 50 applies a darker-coloured ink (e.g. a blue ink). Despite the fact that two different inks are applied on the same areas, tests have shown that there is hardly any contamination of ink between the inking device 13*b* and the inking apparatus 50.

Within the scope of the present invention, it will be appreciated that the inking apparatus 50 could cooperate with any of the other plate cylinders 15*a*, 15*c*, 15*d*, 25*a* to 25*d* and that more than one such inking apparatus 50 could be used. For instance, the inking devices 23*a* and 23*b* on the left-hand side of the printing press could be modified in the same way as inking devices 13*a* and 13*b* with a view to install a second inking apparatus 50 for the other side of the printed sheets. Two inking apparatuses 50 according to the invention could even be used to ink one and a same form cylinder.

Figure 2:
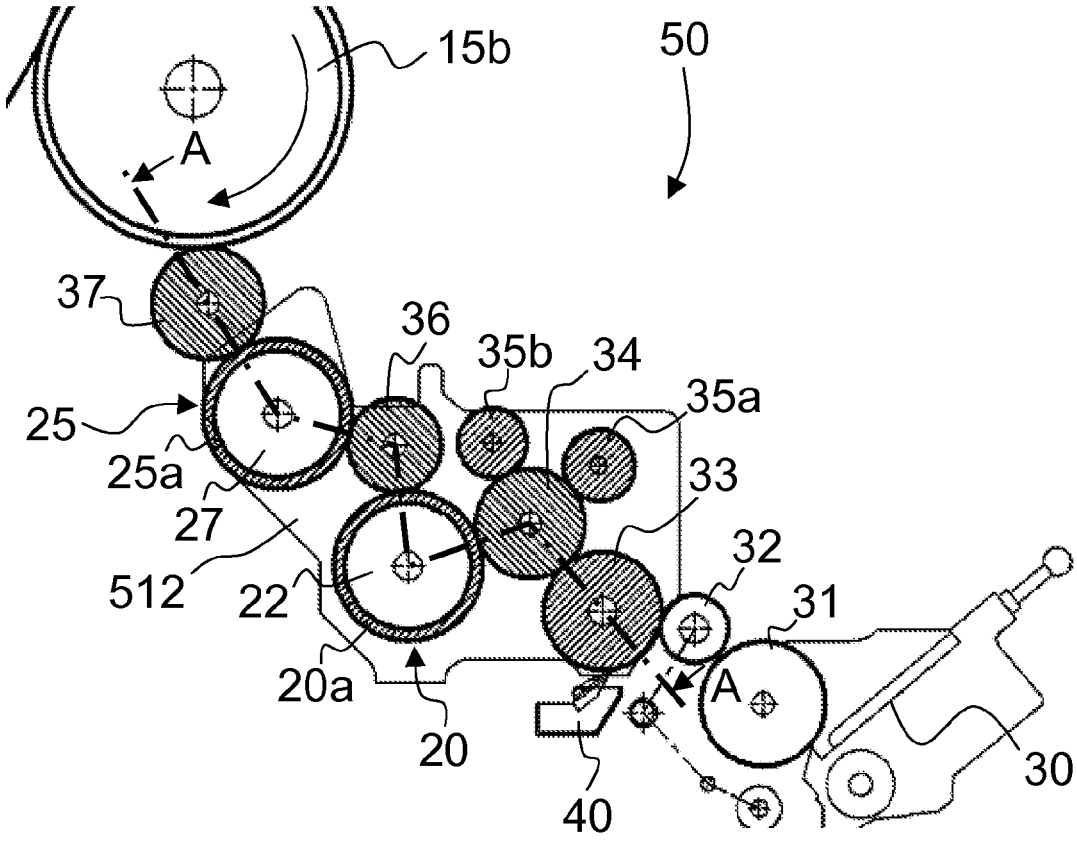
FIG. 2 is a schematic side view of the inking apparatus according to the first embodiment of the invention illustrated in FIGS. 1A to 1C.

One embodiment of the inking apparatus 50 is illustrated in greater details in FIGS. 1C and 2. The inking apparatus 50 comprising first and second chablon cylinders 20 and 25 which are disposed along an inking path of the inking apparatus. An ink fountain 30 with a doctor roller 31 supplies the necessary amount of ink to the inking apparatus 50 in a manner known as such in the art, strips of ink being transferred by means of a vibrator roller 32 to a downstream-located first ink application roller 33. This first ink application roller 33 cooperates in turn with a second ink application roller 34 which contacts the surface of the first chablon cylinder 20. Ink is transferred from the first chablon cylinder 20 to the second chablon cylinder 25 via an intermediate ink transfer roller 36. Lastly, a third ink application roller 37 transfers the ink from the second chablon cylinder 25 to the surface of the associated form cylinder, namely plate cylinder 15*b*. Preferably, a pair of rider rollers 35*a*, 35*b* (referenced in FIG. 2) are disposed along the circumference of the second ink application roller 34. The main purpose of these rider rollers 35*a*, 35*b* is to even the ink film formed on the circumference of the ink application roller 34.

As illustrated in FIG. 2, the inking apparatus 50 is advantageously further provided with a washing device 40 for cleaning purposes. In this example, the washing device 40 cooperates with the first ink application roller 33.

In the illustrated embodiment, plate cylinder 15*b* is also inked by inking device 13*b*. Since the plate cylinder 15*b* is rotating in the clockwise direction, it will be appreciated that the surface of the plate cylinder 15*b* is inked first by the inking device 13*b* and then by the inking apparatus 50.

Figure 10:
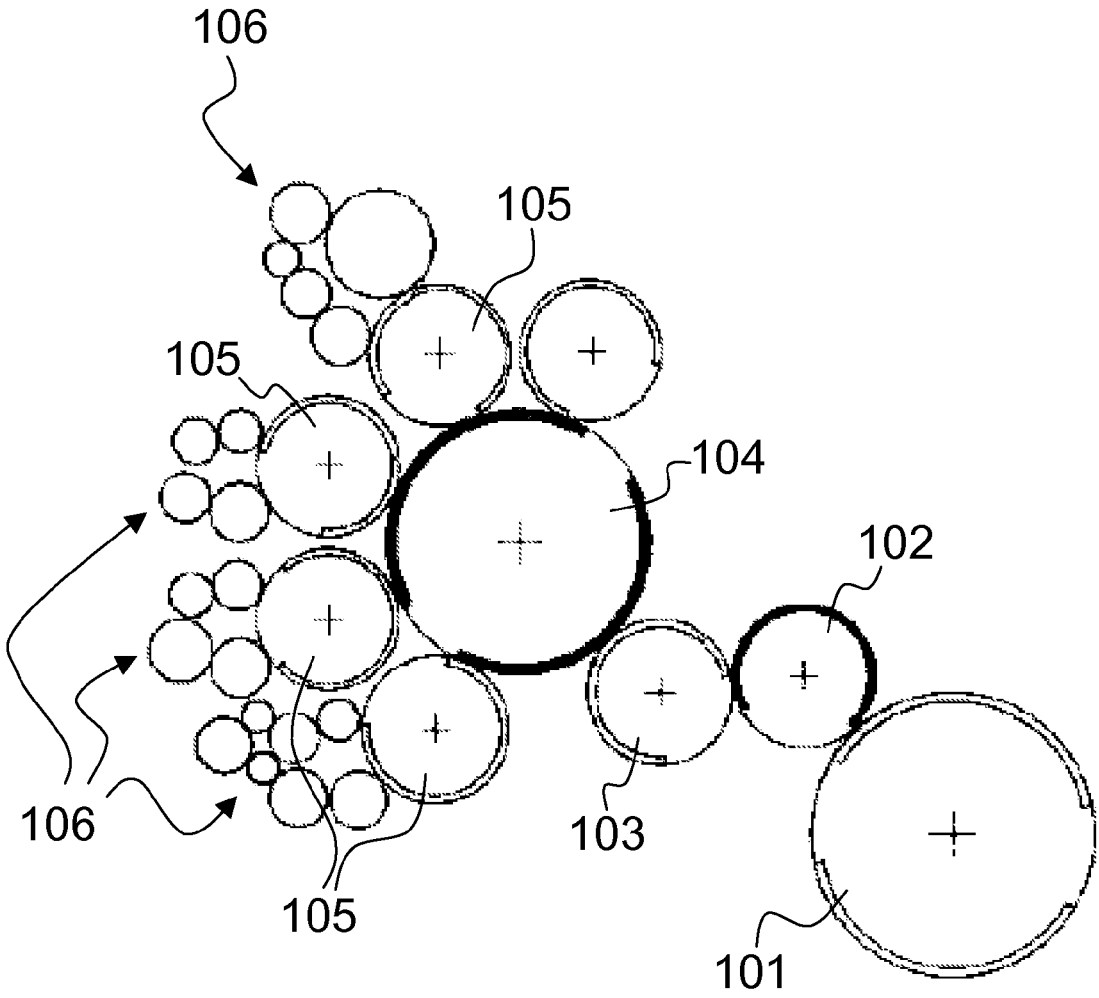
Fig. 10 (PRIOR ART)
FIG. 10 is a schematic illustration of a prior art inking apparatus for two-dimensional ink distribution.

The chablon cylinders 20 and 25 are preferably gapless cylinders (i.e. cylinders having an uninterrupted circumference). In the prior art solution disclosed in RU 2 147 282 C1 (see again FIG. 10), the chablon cylinders 105 are each provided with a cylinder pit comprising clamping means for clamping the corresponding chablon plate, the cylinder pit thus forming an interruption in the circumference of the cylinder, which interruption could cause periodic shocks in the inking system. Gapless cylinders are advantageous in that such shocks are avoided.

According to an advantageous variant, the chablon cylinders 20, 25 comprise a magnetic body 22, 27 carrying a magnetically attractable chablon plate 20*a*, 25*a*, such as steel plates. Alternatively, the chablon cylinders could be made as one cylindrical piece with the chablons formed directly on the circumference thereof. Being able to change only chablon plates is however preferable. The magnetic bodies 22, 27 are preferably permanent magnetic bodies. Alternatively, the magnetic attraction could be generated by electromagnet-type bodies.

The chablon plates 20*a*, 25*a* are designed as plates having a plurality of raised portions corresponding to ink patterns to be formed on the associated plate cylinder 15*b*. These raised portions could take any appropriate shape, a simple example being for instance disk-like portions.

According to still another variant, the chablon cylinders 20 and 25 could advantageously be thermo-regulated so as to ensure a stable operating temperature during operation, it being understood that oscillation of the chablon cylinders 20 and 25 generates heat due to the friction with the contacting inking rollers 34, 36, 37 which do not oscillate.

In order to ease maintenance operations, especially access to the chablon cylinders 20, 25 for replacing the chablon plates 20*a*, 25*a*, the inking rollers and chablon cylinders are designed so as to be easily mounted or dismounted from the machine. In that context, at least the second chablon cylinder 25 is preferably provided with separable cylinder journals so that the main body thereof can be dismounted from the machine without affecting its associated driving mechanism and give access to the upstream-located first chablon cylinder 20. This is achieved by opening the corresponding inking carriage where the inking apparatus 50 is located, removing the ink application roller 37, separating the main body of the second chablon cylinder 25 from its journals, and removing the ink transfer roller 36.

In operation, the two chablon cylinders 20, 25 are oscillated in the axial direction and/or the circumferential direction by associated driving means, while the inking rollers 33, 34, 36, 37 are not oscillated and driven at the machine speed, i.e. rotated at the same circumferential speed as that of the associated form cylinder 15*b*. In the illustrated embodiment, at least inking rollers 34, 36 and 37 are driven by separate driving means. In this example, inking roller 33 is also driven by the separate driving means driving rollers 34, 36 and 37.

More specifically, according to a preferred embodiment, the first and second chablon cylinders 20, 25 are driven by separate servo drives, i.e. in order to control oscillation of both cylinders in an independent manner. More advantageously, each one of the first and second chablon cylinders 20, 25 is driven into rotation and oscillated circumferentially by means of a first servo drive and is oscillated axially by means of a second servo drive. The first servo drive is controlled to drive the corresponding chablon cylinder 20, 25 at an average circumferential speed corresponding to a circumferential speed at which the printing press is running, i.e. at the same circumferential speed as the inking rollers 33, 34, 36, 37, plate cylinders 15*a*-15*d*, 25*a*-25*d* and blanket cylinders 10, 20. As this will be appreciated hereinafter, the provision of two servo drives for each chablon cylinder 20, 25 enables to control axial and circumferential oscillation of each cylinder in any desired way. Separate control of the rotation of each chablon cylinder 20, 25 furthermore enables to control and adjust the angular position of each chablon cylinder 20, 25 independently and precisely.

Figure 3:
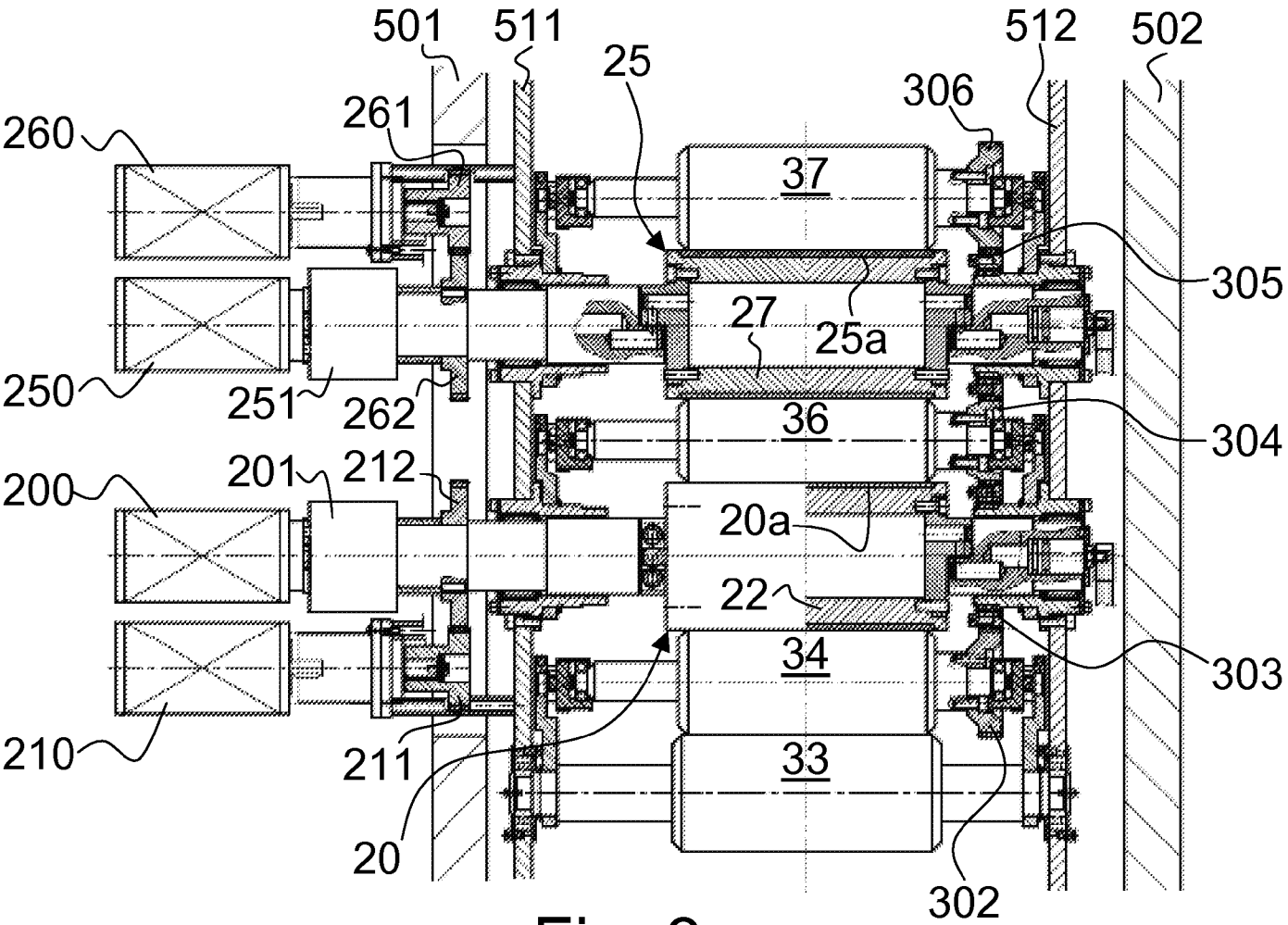
FIG. 3 is a schematic cross-sectional view of the inking apparatus taken along line A-A in FIG. 2 showing driving and gearing arrangements for driving the inking apparatus.

FIG. 3 is a cross-section of a preferred variant of the inking apparatus 50 of FIG. 2 taken along line A-A in FIG. 2, i.e. a cross-section through the rotation axes of the ink application roller 37, the second chablon cylinder 25 (with its chablon plate 25*a*, magnetic body 27 and, preferably, separable cylinder journals, not referenced), the ink transfer roller 36, the first chablon cylinder 20 (with its chablon plate 20*a* and magnetic body 22), the ink application roller 34 and the ink application roller 33. As schematically illustrated in FIG. 3, the first and second chablon cylinders 20, 25 and the ink rollers 33, 34, 36 (as well as the rider rollers 35*a*, 35*b*, not shown in FIG. 3) are mounted between supporting frames 511, 512 located between side frame parts 501, 502 of the inking carriage where the inking apparatus 50 is located.

According to this preferred variant, axial and circumferential oscillation of each chablon cylinder 20, 25 is controlled by means of separate drives 200, 210, 250, 260. More precisely, axial oscillation of the first and second chablon cylinders 20, 25 is controlled by first and second servo drives 200 and 250, respectively, each servo drive 200, 250 being coupled to the shaft of the corresponding chablon cylinder 20, 25 via an oscillation mechanism 201, 251 respectively. This oscillation mechanism 201, 251 can as such be similar to known oscillation mechanisms for laterally distributing ink. Alternatively, a common drive mechanism could be used to oscillate both chablon cylinders in the axial direction. It is however preferable to use separate drives as this provides the greatest flexibility as to the manner one wishes to oscillate both chablon cylinders 20, 25. Circumferential oscillation of the first and second chablon cylinders 20, 25 is preferably controlled by third and fourth servo drives 210 and 260, respectively, each servo drive 210, 260 being operatively coupled to the shaft of the corresponding chablon cylinder 20, 25 via a gearing arrangement comprising a pair of gears 211-212, 261-262, respectively. As already mentioned, the servo drives 210, 260 are controlled to drive the corresponding chablon cylinders 20, 25 at an average circumferential speed corresponding to a circumferential speed at which the printing press is running (which circumferential speed can be said to be the "machine speed"). Thanks to this drive arrangement, oscillation of both chablon cylinders 20, 25 can be controlled independently for each cylinder 20, 25, as well as for each oscillation direction.

Figure 4:
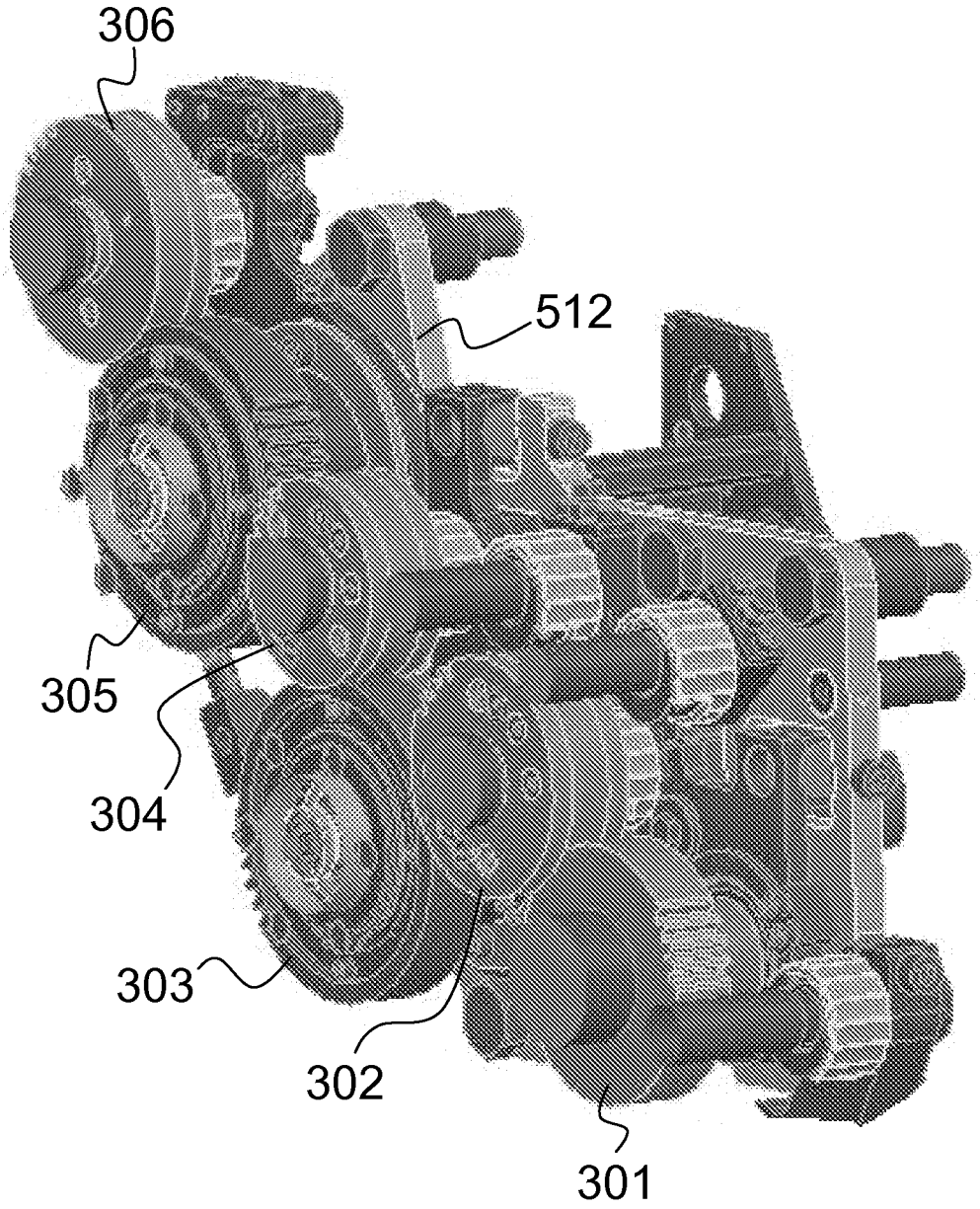
FIG. 4 is a schematic perspective view of the gearing arrangement of the inking apparatus of FIG. 3.

On the other hand, the ink application roller 37, the ink transfer roller 36, the ink application roller 34 (and preferably the ink application roller 33 as well) are driven by a separate drive (not shown in FIG. 3) so that the circumferential speed thereof corresponds to the circumferential speed of the associated form cylinder (i.e. the "machine speed"). To this end, the ink rollers 37, 36, 34, 33 are coupled to each other by means of a common gearing arrangement comprising gears 301 to 306 (gear 301 being only visible in FIG. 4 which is a perspective view of the said gearing arrangement). As shown in FIGS. 3 and 4, gears 301 to 306 are advantageously located at one extremity of the shafts of ink application roller 33, ink application roller 34, first chablon cylinder 20, ink transfer roller 36, second chablon cylinder 25 and ink application roller 37, respectively. Since the first and second chablon cylinders 20, 25 are driven into rotation by their corresponding drives 210, 260, gears 303 and 305 are mounted so as to be freely rotatable about the axis of the chablon cylinders 20, 25 (for instance by means of ball-bearings).

The gearing arrangement 301 to 306 shown in FIGS. 3 and 4 is not limitative and could be replaced by any other suitable driving mechanism provided it can ensure that the ink rollers 37, 36, 34 and 33 are driven at the same circumferential speed as that of the form cylinder 15*b*.

The amplitude of the cyclical oscillation movements along the axial and/or circumferential direction is adjustable, preferably within an amplitude range of 0 to ±2 mm. In addition, the oscillation frequency of the cyclical oscillation movements along the axial and/or circumferential direction is also adjustable, preferably within a frequency range of 0 to 3 Hz. Adjustment of the frequency is advantageously made in dependence of the speed at which the printing press (i.e. as a function of the circumferential speed of the form cylinder 15*b*). In addition, a ratio between the oscillation frequency of the cyclical oscillation movements and a rotational frequency of the form cylinder 15*b* shall preferably be selected to be an irrational number, i.e. a number which cannot be expressed as a fraction of two integers, this ensuring a uniform distribution of ink.

As already mentioned hereinabove, each chablon plate 20*a*, 25*a* carries a plurality of raised portions corresponding to ink patterns to be formed on the associated plate cylinder 15*b*. Ink is thus transferred from the ink application roller 34 to the ink-carrying portions of the first chablon plate 20*a*, all ink-carrying portions of the first chablon plate 20*a* being uniformly inked in the process. The ink is then transferred from the ink-carrying portions of the first chablon plate 20*a* to the surface of the ink transfer roller 36, there being a relative movement in the axial and/or circumferential directions between the first chablon plate 20*a* and the ink transfer roller 36 due to the oscillation of the first chablon cylinder 20. As a result of the oscillation, each ink-carrying portions of the first chablon plate 20*a* will deposit a corresponding patch of ink on the surface of the ink transfer roller 36 at positions changing from one revolution of the roller to the next, thereby performing a distribution of ink in the axial and/or circumferential directions. The resulting ink patches on the surface of the ink transfer roller 36 are then transferred in a similar manner on the ink-carrying portions of the second chablon plate 25*a*, a second distribution of ink (axial and/or circumferential) being thus performed in the process. The ink is further transferred from the ink-carrying portions of the second chablon plate 25*a* to the surface of the ink application roller 37, thereby performing another distribution of ink in the process. The resulting ink patches on the surfaces of the ink application roller 37 are then transferred onto the surface of the form cylinder 15*b*.

In other words, a main advantage of the inking apparatus of the present invention as compared to the prior art resides in the fact that its enables a better and more uniform distribution of ink in both the axial and circumferential directions. Indeed, it will be appreciated that a first distribution of ink along the axial and circumferential directions is performed upon transfer of the ink from the first chablon cylinder 20 to the ink transfer roller 36. A second distribution of ink is performed upon transfer of the ink from the ink transfer roller 36 to the second chablon cylinder 25. Finally, a third distribution of ink is performed upon transfer of the ink from the second chablon cylinder 25 to the ink application roller 37. This process is schematically illustrated in FIG. 5.

In a first approximation, it can be assumed that, in a conventional inking system where ink is transferred from a first roller/cylinder to a second roller/cylinder, the ink film is divided in two parts of substantially equal thickness, one part remaining on the upstream-located roller/cylinder, while the other part is transferred onto the surface of the downstream-located roller/cylinder. This assumption also applies in the present case.

Figure 5:
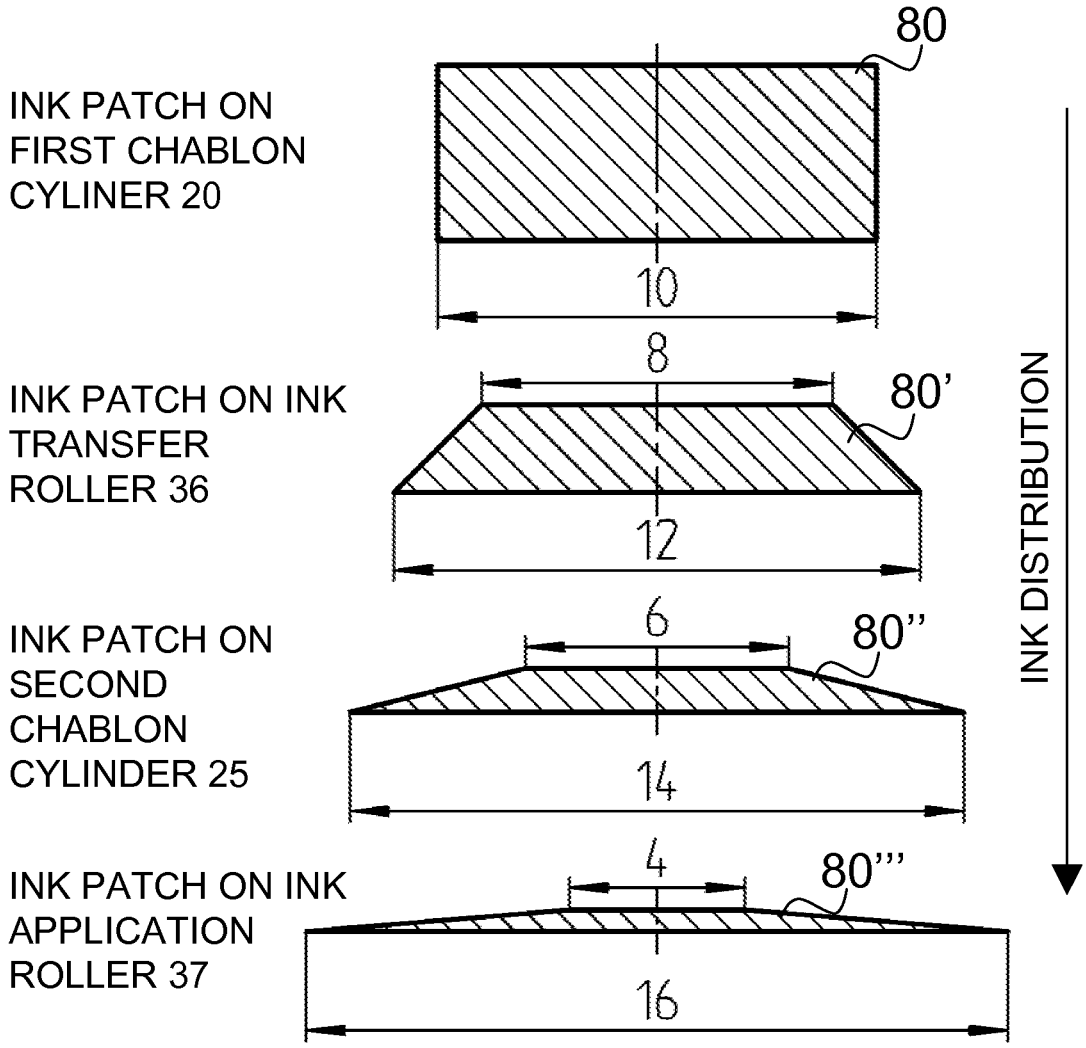
FIG. 5 is a schematic view illustrating distribution of ink along the inking path of the inking apparatus of the invention.

In FIG. 5, it is assumed for the sake of simplicity that the chablon plate 20*a* on the first chablon cylinder 20 is provided with 10-mm-wide ink-carrying portions. It is also assumed that the distribution of ink is performed according to a perfectly circular distribution pattern (i.e. by oscillating the chablon cylinders 20, 25 according to sinusoidal oscillation patterns with a phase difference of ninety degrees between axial oscillation and circumferential oscillation, and identical oscillation frequencies and amplitudes in both the axial and circumferential directions, as this will be discussed hereinafter). For the sake of illustration, it is furthermore assumed that oscillation amplitude is ±1 mm in all directions.

As schematically illustrated in the upper part of FIG. 5, an ink-carrying portion on the chablon plate 20*a* of the first chablon cylinder 20 would carry a 10-mm wide patch of ink 80 of a given thickness. Upon transfer from the first chablon cylinder 20 to the ink transfer roller 36, approximately half of the ink is transferred to the surface of the ink transfer roller 36 and is distributed in all directions. After several revolutions of the ink transfer roller 36, there results an ink patch 80' with an inner core of substantially constant thickness and approximately 8 mm diameter with a surrounding annular region exhibiting a gradually-decreasing ink gradient towards the edges, the outer perimeter of the ink patch 80' reaching approximately 12 mm. Upon this first transfer of ink, the ink gradient extends over a distance of approximately 2 mm around the inner core.

Upon transfer from the ink transfer roller 36 to the second chablon cylinder 25, a similar distribution of ink occurs, thereby leading, after several rotations of the second chablon cylinder 25, to an ink patch 80" with an inner core of substantial constant thickness and approximately 6 mm diameter, again with a surrounding region exhibiting a gradually-decreasing ink gradient towards the edges, the outer perimeter of the ink patch 80" reaching in this case approximately 14 mm. It is assumed in this case that the ink-carrying portions on the chablon plate 25*a* of the second chablon cylinder 25 are at least 14 mm wide. Upon this second transfer of ink, the ink gradient extends over a distance of approximately 4 mm around the inner core.

Upon transfer from the second chablon cylinder 25 to the ink application roller 37, the ink is further distributed. There results, after several revolutions of the ink application roller 37, an ink patch 80''' exhibiting approximately a 4 mm wide inner core with an annular surrounding region extending over a distance of approximately 6 mm around the inner core, the ink patch 80''' thus reaching an overall diameter of approximately 16 mm.

Thanks to the use of two chablon cylinders, a distribution of ink is thus performed over a wider area than with the prior art solution.

Oscillation in the axial direction and circumferential direction of each chablon cylinder 20, 25 can be performed in various ways, depending on the desired distribution of ink. Some examples will be briefly described hereinafter in reference to FIGS. 6A to 6E which illustrate possible ink distribution patterns. More precisely, FIGS. 6A to 6E illustrate different trajectories 800 that would be followed by an ink pattern over several cylinder revolutions depending on selected oscillation parameters. Reference O in FIGS. 6A to 6E designates a nominal (or reference) position of the ink pattern about which the ink is distributed as a result of the oscillation in the axial and circumferential directions.

Figure 6A:
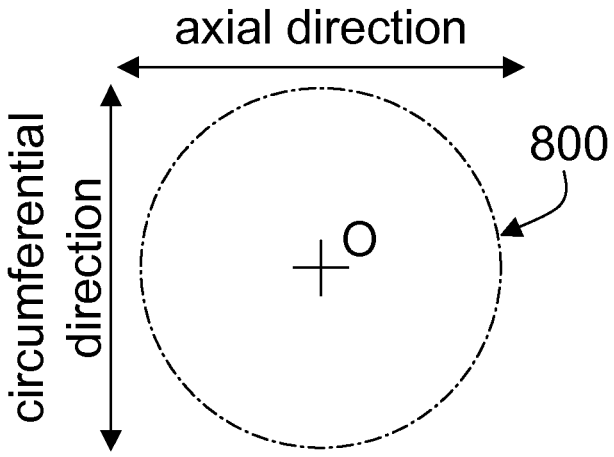
FIGS. 6A to 6E illustrate various possibilities for distributing ink along both the axial and circumferential directions.
Figure 6B:
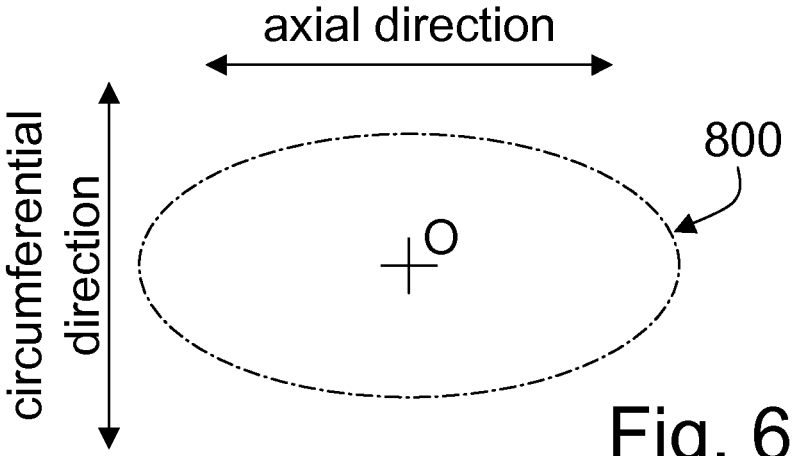
Figure 6C:
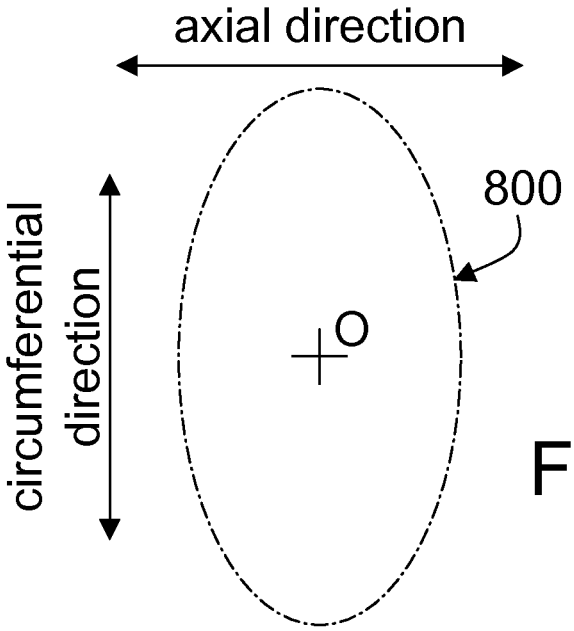

For instance, if the cyclical oscillation movements in the axial and circumferential directions are sinusoidal movements with identical oscillation frequencies and with a phase difference of ninety degrees, one achieves a distribution of ink in all directions. Moreover, if the amplitude of oscillation is the same in each direction one achieves a perfectly circular distribution of ink as schematically illustrated in FIG. 6A, the distribution of ink following a circular trajectory 800 about the nominal position O. By playing with the amplitudes along the axial and circumferential directions, one could achieve a distribution of ink according to any other elliptical trajectory 800 about the nominal position O as depicted in FIGS. 6B and 6C. FIG. 6B for instance disclose the situation where the oscillation amplitude is greater along the axial direction than along the circumferential direction. FIG. 6C illustrates the opposite situation.

Figure 6D:
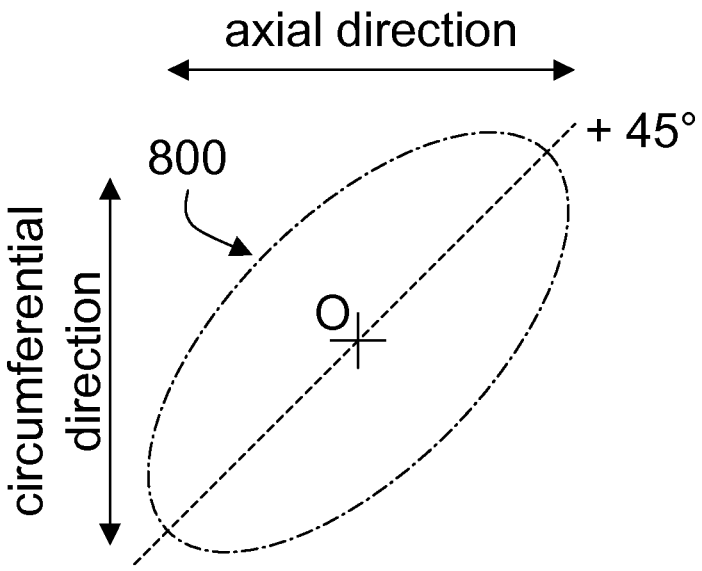
Figure 6E:
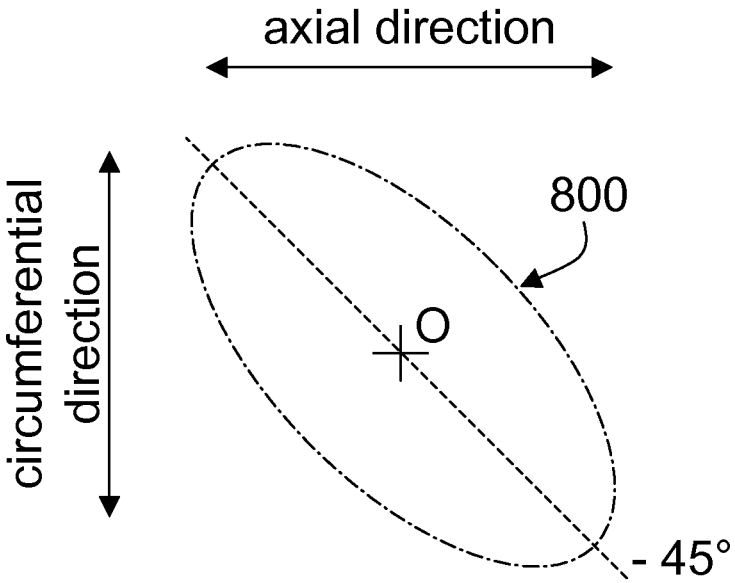

Similarly, by playing with the phase difference between the oscillation movements along the axial and circumferential directions, one can distribute the ink along elliptical patterns 800 about the nominal position O having a main axis oriented at ±45° with respect to the axial direction as schematically illustrated in FIGS. 6D and 6E. In the case of FIG. 6D, the phase difference is comprised between 0 and 90°, whereas, in the case of FIG. 6E, the phase difference is comprised between 90° and 180°. In the extreme case, if the phase difference is 0° or 180°, the distribution will be made along a line oriented at +45° or −45°, respectively, with respect to the axial direction.

Still according to another example, the oscillation frequencies of the oscillation movements along the axial and circumferential directions could be different, thereby leading to non-elliptical ink distribution patterns along the two directions.

Both chablon cylinders 20, 25 could be oscillated in the same manner or, alternatively, with different oscillation parameters. One could for instance operate the first chablon cylinder 20 with oscillation parameters so as to create a distribution of ink along a main axis oriented at +45° with respect to the axial direction (i.e. in the manner illustrated in FIG. 6D), while the second chablon cylinder 25 is operated with oscillation parameters such that the distribution of ink is performed along a main axis oriented at −45° with respect to the axial direction (i.e. in the manner illustrated in FIG. 6E).

In a similar, manner the first chablon cylinder 20 could be oscillated exclusively in the axial direction, while the second chablon cylinder 25 could be oscillated exclusively in the circumferential direction (or vice versa). This would lead to the formation of an ink patch having a square or rectangle outer shape.

In all of the above examples, its was assumed that the amplitude of oscillation along the axial and circumferential direction remains constant, thereby leading to symmetrical ink distribution patterns. One could alternatively oscillate the chablon cylinders 20, 25 with a non-constant oscillation amplitude so as to create dissymmetrical ink distribution patterns.

It will again be understood that the provision of two independent servo drives for each chablon cylinder 20, 25 advantageously offers the greatest flexibility in the way the ink can be distributed along the axial and circumferential directions. It will also be appreciated that the use of two chablon cylinders located in the inking path opens new possibilities in the manner in which the ink is distributed two-dimensionally.

Figure 7A:
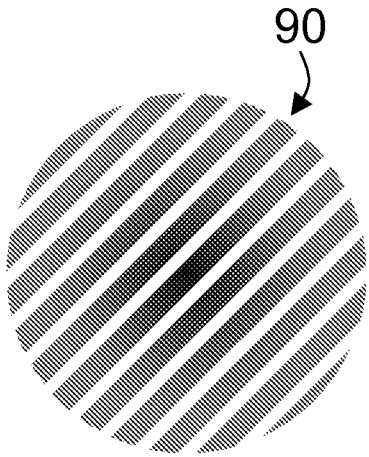
FIGS. 7A and 7B are exemplary illustrations of printed patterns produced as a result of the two-dimensional ink distribution.
Figure 7B:
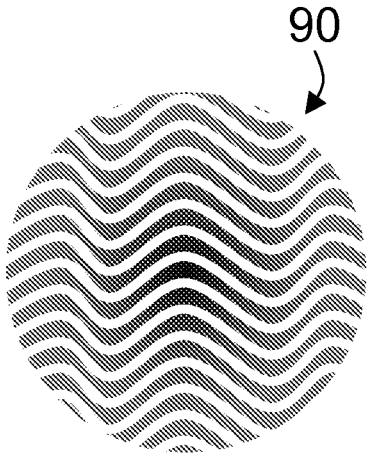

It shall be understood that the printing plate carried by the plate cylinder 15*b* would typically be structured with a pattern of dots, lines and/or other geometrical patterns, such that only a part of the ink pattern is transferred from the inking apparatus 50 (i.e. from the ink application roller 37 in the illustrated example) onto the surface of the printing plate. FIGS. 7A and 7B for instance illustrate two non-limiting examples of patterns 90 that could be created on the printed sheets using a structured printing plate exhibiting printing portions in the form of rectilinear or curvilinear lines, and whereby distribution of ink is performed according to a circular distribution pattern as illustrated in FIG. 6A, the central part of the printed patterns 90 exhibiting a darker tone while the external part exhibits an ink gradient wherein ink density gradually decreases towards the edges of the pattern.

In the illustrated embodiment, the distribution of ink is ensured by a cooperation of the first and second chablon cylinders 20, 25, of the ink transfer roller 36 and of the ink application roller 37. In an alternate embodiment, the second chablon cylinder 25 could directly ink the surface of the form cylinder 15*b* and the ink application roller 37 could thus be avoided. The use of an intermediate ink application roller between the form cylinder 15*b* and the second chablon cylinder 25 is however preferred in that it advantageously prevents the oscillations of the chablon cylinder 25 from causing too extensive wear of the surface of the printing plate carried by the form cylinder 15*b*, there being only a rolling contact between the form cylinder 15*b* and the ink application roller 37.

In the context of the present invention, one wishes to ink determined locations of the surface of the form cylinder 15*b*, both axially and along the circumference of the cylinder. The form cylinder 15*b* is of a given and fixed diameter, which diameter is determined by the desired printing length and the number of printing segments (i.e. the number of printing plates carried by the form cylinder). In the illustrated embodiment, the form cylinder 15*b* is a one-segment cylinder, i.e. a cylinder carrying only one printing plate. A typical diameter of a one-segment form cylinder is for instance 280.20 mm, which diameter amounts to a cylinder outer circumference of 880.274 mm. It is worth noting that the form cylinder 15*b* could have more than one segment and that what matters is the corresponding reference diameter of a one-segment cylinder. The reference diameter D0 of a one-segment cylinder can be defined as follows, where D designates the actual diameter of the form cylinder to be inked and p designates the number of printing segments of the form cylinder (in the illustrated embodiment p=1 and D0=D):

$$D0=D/p \tag{1}$$

The position of the ink patterns along the axial direction is not as such an issue, any axial position being possible. As regards the positioning of the ink patterns along the circumferential direction, one has to ensure that the nominal location of each ink pattern along the circumference of the form cylinder remains the same revolution after revolution. In the context of the present invention, this implies that the diameters of the first and second chablon cylinders 20, 25 and of the inking rollers 36 and 37 have to satisfy certain rules as compared to the above-mentioned reference diameter D0 as this will be explained hereinafter.

From a general point of view, in order to achieve the desired distribution of ink, the ratio between the diameter of each one of the first and second chablon cylinders 20, 25, the ink transfer roller 36 and the ink application roller 37 and the reference diameter D0 must be a rational number, i.e. a number which can be expressed as a ratio of two integers (or fraction). This ensures a proper distribution of ink in the circumferential direction and at the desired location along the circumference of the plate cylinder 15*b*.

One solution may consist in using chablon cylinders 20, 25 and inking rollers 36, 37 having a diameter equal to an integer multiple of the reference diameter D0. While this solution is possible and falls within the scope of the present invention, it is not preferred since this solution requires a substantial amount of space to accommodate the chablon cylinders and inking rollers in the inking system, which space is typically limited in practice.

A preferred solution from the point of view of the required installation space is to select chablon cylinders 20, 25 and inking rollers 36, 37 having a smaller diameter than the reference diameter D0. In this case, the diameters of the chablon cylinders 20, 25 and inking rollers 36, 37 have to be chosen carefully as this has an impact on the distance between two successive ink patterns in the circumferential direction, i.e. along the length of the sheets, as this will be explained hereinafter.

Let us define for the purpose of the explanation that the ratio between the diameter of each one of the first and second chablon cylinders 20, 25, the ink transfer roller 36 and the ink application roller 37 and the reference diameter D0 are defined by the following irreducible fractions (2) to (5), where D20, D25, D36 and D37 respectively designate the diameters of the first chablon cylinder 20, of the second chablon cylinder 25, of the ink transfer roller 36 and of the ink application roller 37:

$$D20/D0=\alpha1/\beta1 \tag{2}$$

$$D25/D0=\alpha2/\beta2 \tag{3}$$

$$D36/D0=\alpha3/\beta3 \tag{4}$$

$$D37/D0=\alpha4/\beta4 \tag{5}$$

In the above examples, it shall be understood that the pairs of integers $\alpha1:\beta1$, $\alpha2:\beta2$, $\alpha3:\beta3$, $\alpha4:\beta4$ are coprime integers, i.e. numbers having no common divisors except 1.

In this case, proper distribution of ink can only be ensured if the circumference of the form cylinder 15*b* is subdivided into an integer number of intervals of equal lengths. Such rule can be expressed as a function of the reference diameter D0 defined in expression (1) above in the form of the following equation (6), where Δ designates the distance between two successive ink patterns in the circumferential direction (which distance is referred to hereinafter as "image interval") and s0 is an integer:

$$\Delta \cdot s0 = \pi \cdot D0 \quad (6)$$

The same is true for the chablon cylinders 20, 25 and for the inking rollers 36, 37, namely the circumference thereof must be such that it corresponds to an integer multiple of the image interval Δ, as defined by the following equations (7) to (10), where s1, s2, s3, s4 are again integers:

$$\Delta \cdot s1 = \pi \cdot D20 \quad (7)$$

$$\Delta \cdot s2 = \pi \cdot D25 \quad (8)$$

$$\Delta \cdot s3 = \pi \cdot D36 \quad (9)$$

$$\Delta \cdot s4 = \pi \cdot D37 \quad (10)$$

By substituting image interval Δ in equations (7) to (10) above with its value coming from equation (6), one can express integers s1, s2, s3, s4 as follows:

$$s1 = s0 \cdot D20/D0 = s0 \cdot \alpha 1/\beta 1 \quad (11)$$

$$s2 = s0 \cdot D25/D0 = s0 \cdot \alpha 2/\beta 2 \quad (12)$$

$$s3 = s0 \cdot D36/D0 = s0 \cdot \alpha 3/\beta 3 \quad (13)$$

$$s4 = s0 \cdot D37/D0 = s0 \cdot \alpha 4/\beta 4 \quad (14)$$

Considering expressions (11) to (14) above, numbers s1, s2, s3, s4 are all integer numbers only if integer number s0 is an integer multiple of the least common multiple (lcm) of the denominators β1, β2, β3, β4. For instance, if the least common multiple of denominators β1, β2, β3, β34 of the irreducible fractions (2) to (5) is equal to 15, then number s0 can be any multiple of 15, i.e. the circumference of the one-segment form cylinder 15*b* can be subdivided into 15, 30, 45, 60, etc. subdivisions of equal lengths. In case the form cylinder 15*b* is a one-segment cylinder having a diameter of 280.20 mm, this means in turn that the possible image intervals Δ will be 58.685 mm, 29.342 mm, 19.562 mm, 14.671 mm, etc.

Many solutions are thus possible depending on the selected diameter ratios and the desired image intervals Δ. For the sake of further illustration, one will assume that the ratios between the diameter of each one of the first and second chablon cylinders 20, 25, the ink transfer roller 36 and the ink application roller 37 and the diameter of the form cylinder 15*b* are as follows:

$$D20/D0 = 8/17 \quad (15)$$

$$D25/D0 = 8/17 \quad (16)$$

$$D36/D0 = 5/17 \quad (17)$$

$$D37/D0 = 6/17 \quad (18)$$

Considering a diameter D0 of 280.20 mm, this would lead to the following diameters D20, D25, D36, D37:

$$D20 = 131.859 \text{ mm} \quad (19)$$

$$D25 = 131.859 \text{ mm} \quad (20)$$

$$D36 = 82.412 \text{ mm} \quad (21)$$

$$D37 = 98.894 \text{ mm} \quad (22)$$

In the above example, the denominators β1, β2, β3, β4 in the irreducible ratios (15) to (18) are all preferably equal to a same number, namely 17 (the least common multiple thereof being thus also equal to 17). Considering the above-indicated diameter ratios, various image intervals are possible as summarized in Table 1 hereafter, where the resulting integers s0, s1, s2, s3, s4 are also listed:

TABLE 1

| | Number of subdivisions of the circumference of: | | | |
|---|---|---|---|---|
| Image interval Δ | plate cylinder 15b (s0) | chablon cylinders 20, 25 (s1, s2) | ink transfer roller 36 (s3) | ink application roller 37 (s4) |
| 51.781 mm | 17 | 8 | 5 | 6 |
| 25.890 mm | 34 | 16 | 10 | 12 |
| 17.260 mm | 51 | 24 | 15 | 18 |
| 12.945 mm | 68 | 32 | 20 | 24 |
| 10.356 mm | 85 | 40 | 25 | 30 |
| 8.630 mm | 102 | 48 | 30 | 36 |
| 7.397 mm | 119 | 56 | 35 | 42 |
| 6.473 mm | 136 | 64 | 40 | 48 |
| 5.753 mm | 153 | 72 | 45 | 54 |
| 5.178 mm | 170 | 80 | 50 | 60 |
| 4.707 mm | 187 | 88 | 55 | 66 |
| 4.315 mm | 204 | 96 | 60 | 72 |

Figure 8:
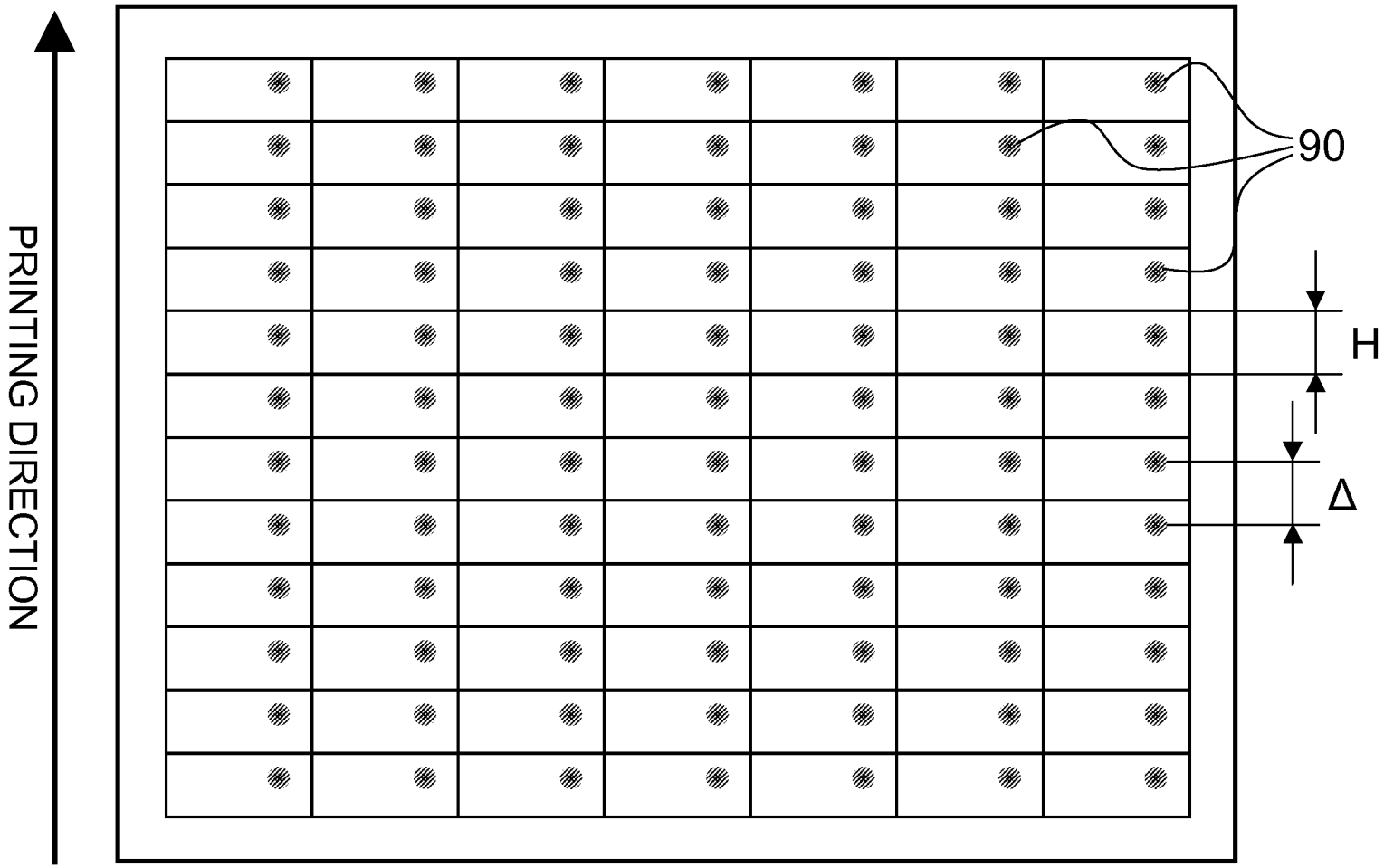
FIG. 8 is a schematic illustration of a sheet carrying a plurality of security imprints arranged in a matrix of rows and columns, wherein each security imprint is provided with a printed patterns produced as a result of the two-dimensional ink distribution.

In the context of the production of banknotes where each printed sheet carries a plurality of banknote imprints arranged in an array of m rows and n columns (as schematically illustrated in FIG. 8 where the number of rows and columns of banknote imprints per sheet is purely illustrative), the image interval Δ has to be considered when selecting the dimension of the banknote along the length of the sheets (which dimension usually corresponds to the height H of the banknotes). By adopting a dimension of the banknote along the length of the sheet which corresponds to an integer multiple of the selected image interval Δ, one ensures that the resulting ink patterns (designated by reference numeral 90 in FIG. 8) will be formed at a determined and fixed position relative to the edges of each banknote. Depending on the selected banknote dimension H and image interval Δ, one or more ink patterns will be formed on each banknote. FIG. 8 illustrates the situation where the banknote height H is selected to correspond substantially to the image interval Δ. One will understand that if the banknote height H is selected to be equal to twice the image interval Δ, each banknote will be provided with two ink patterns along its height.

If variations are accepted from one banknote to another, then one could depart from the above rule. For instance, by adopting a banknote height H of 51.9 mm and an image interval Δ of 51.781 mm, the actual position of the resulting ink pattern 90 on each banknote will slightly change from one row of banknotes to another on a same sheet, the offset from one row to the next amounting to the difference between height H and interval Δ, i.e. 0.119 mm in the above example.

Figure 9:
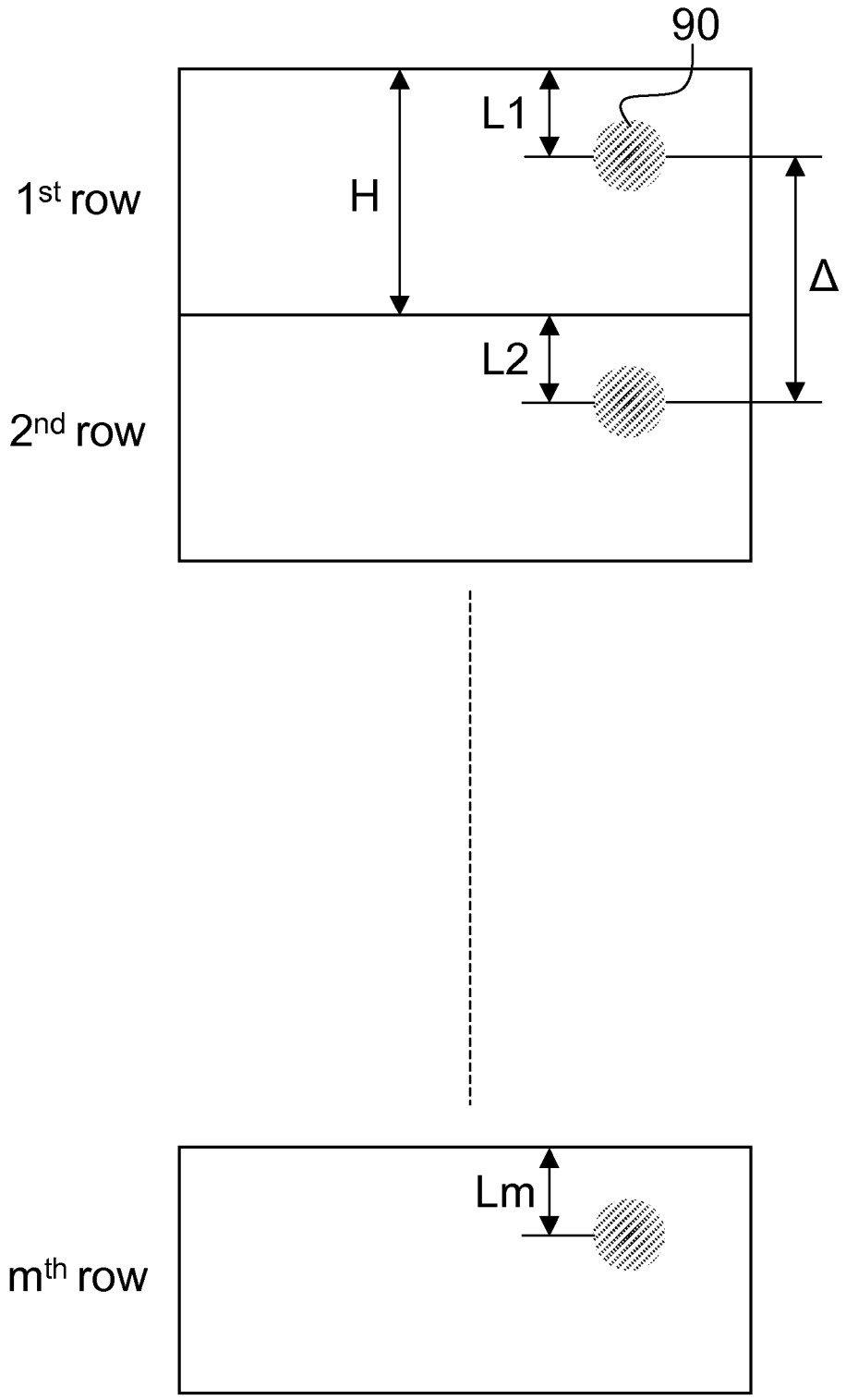
FIG. 9 is a schematic illustration of the positions of each security imprint within one column of security imprints of a sheet.

FIG. 9 schematically illustrates the position of the ink patterns 90 on the banknotes of successive rows, only the first, second and last ($m^{th}$) rows being illustrated. If the height H corresponds to the image interval Δ (or an integer multiple thereof), the distance of the first ink pattern 90 on each banknote with respect to an upper edge thereof (i.e. distance L1, L2, . . . , Lm in FIG. 9) remains constant. In the case of a difference between height H and interval Δ, the distance L1, L2, . . . , Lm will change from one row to another. Considering the above-mentioned example where the banknote height H equals 51.9 mm and the image interval Δ equals 51.781 mm, and a sheet with twelve rows of banknotes as schematically illustrated in FIG. 8, the position of the resulting ink pattern 90 with respect to the banknote edge on the last ($m^{th}$) row of banknotes on the sheet will be offset by 1.309 mm as compared to the position of the resulting ink pattern 90 with respect to the banknote edge on the first row of banknotes (the offset amounts to the difference, $|H-\Delta|$, between the banknote height H and the image interval $\Delta$, multiplied by the number of rows minus one, $(m-1)$), i.e. distance Lm would be shorter than distance L1 by an amount of 1.309 mm in this case.

Preferably the banknote height H should be chosen so as to be as close as possible to an integer multiple of the selected image interval $\Delta$ so as to limit overall offset of the ink patterns between the first and last rows of banknotes.

Various modifications and/or improvements may be made to the above-described embodiments without departing from the scope of the invention as defined by the annexed claims. For instance, while the invention was described in the context of a printing press adapted for simultaneous recto-verso printing, the invention is equally applicable to a printing press adapted for consecutive recto-verso printing or for single-side printing. The invention is furthermore applicable to printing processes other than offset printing.

The invention claimed is:

1. An inking apparatus for forming an ink pattern on the surface of a form cylinder of a printing press, which ink pattern exhibits, at least in part, a two-dimensional ink gradient extending in an axial direction and a circumferential direction on the surface of the form cylinder, wherein said inking apparatus comprises an ink train having at least first and second chablon cylinders which are placed one after the other along an inking path of said ink train for distributing ink in the axial and circumferential directions and means for subjecting said first and second chablon cylinders to cyclical oscillation movements in the axial direction and the circumferential direction.

2. The inking apparatus according to claim 1, further comprising an ink transfer roller contacting the first and second chablon cylinders for transferring ink from the first chablon cylinder to the second chablon cylinder.

3. The inking apparatus according to claim 2, wherein a ratio between a diameter of each one of said first and second chablon cylinders, and said ink transfer roller and a reference diameter corresponding to the diameter of a one-segment cylinder of the printing press is a rational number, i.e. a number which can be expressed as a ratio of two integers.

4. The inking apparatus according to claim 3, wherein said first and second chablon cylinders, and said ink transfer roller have a diameter smaller than said reference diameter.

5. The inking apparatus according to claim 2, further comprising an ink application roller contacting the second chablon cylinder and the form cylinder for transferring ink from the second chablon cylinder to the surface of the form cylinder.

6. The inking apparatus according to claim 5, wherein a ratio between a diameter of each one of said first and second chablon cylinders, said ink transfer roller and said ink application roller and a reference diameter corresponding to the diameter of a one-segment cylinder of the printing press is a rational number, i.e. a number which can be expressed as a ratio of two integers.

7. The inking apparatus according to claim 6, wherein said first and second chablon cylinders, said ink transfer roller and said ink application roller have a diameter smaller than said reference diameter.

8. The inking apparatus according to claim 1, wherein a ratio between an oscillation frequency of the cyclical oscillation movements and a rotational frequency of the form cylinder is selected to be an irrational number, i.e. a number which cannot be expressed as a fraction of two integers.

9. The inking apparatus according to claim 1, wherein said first and second chablon cylinders are gapless cylinders.

10. The inking apparatus according to claim 1, wherein said first and second chablon cylinders comprise a magnetic body carrying a magnetically attractable chablon plate.

11. The inking apparatus according to claim 10, wherein the magnetic body is a permanent magnetic body.

12. The inking apparatus according to claim 1, wherein said first and second chablon cylinders are thermo-regulated.

13. The inking apparatus according to claim 1, further comprising an inking roller for inking said first chablon cylinder and two rider rollers contacting a circumference of said inking roller.

14. The inking apparatus according to claim 13, further comprising an ink fountain with a doctor roller, an ink vibrator roller for taking up ink from the doctor roller, and an ink transfer roller for transferring ink from the ink vibrator roller to said inking roller.

15. The inking apparatus according to claim 1, wherein each one of said first and second chablon cylinders is oscillated in the axial direction by means of a first servo drive and is oscillated in the circumferential direction by means of a second servo drive driving the chablon cylinder at an average circumferential speed corresponding to a circumferential speed of the form cylinder, said second servo drive being controlled in such a way as to cyclically accelerate and decelerate the chablon cylinder.

16. The inking apparatus according to claim 1, comprising:

an ink transfer roller contacting the first and second chablon cylinders for transferring ink from the first chablon cylinder to the second chablon cylinder; and an ink application roller contacting the second chablon cylinder for transferring ink therefrom and for directly or indirectly applying this ink on the surface of the form cylinder, wherein said ink transfer roller and said ink application roller are connected by gears and are driven into rotation by means of a common independent drive at an average circumferential speed corresponding to a circumferential speed of the form cylinder.

17. The inking apparatus according to claim 16, wherein said gears include freely-rotatable gears mounted for rotation about the axis of said first and second chablon cylinders.

18. The inking apparatus according to claim 1, wherein the amplitude, frequency and/or phase of the cyclical oscillation movements along the axial and/or circumferential direction is adjustable.

19. A sheet-fed or web-fed printing press comprising at least a first form cylinder and at least a first inking apparatus according to claim 1 for inking the surface of said first form cylinder.

20. A method for forming an ink pattern on the surface of a form cylinder of a printing press, which ink pattern exhibits, at least in part, a two-dimensional ink gradient extending in an axial direction and a circumferential direction on the surface of the form cylinder, wherein said method comprises the steps of:

providing at least first and second chablon cylinders one after the other along the inking path of an ink train inking said form cylinder; and distributing ink in the axial direction and the circumferential direction by subjecting the said first and second chablon cylinders to cyclical oscillation movements in the axial direction and the circumferential direction.

* * * * *